US007185607B1

(12) United States Patent
Pearson

(10) Patent No.: US 7,185,607 B1
(45) Date of Patent: Mar. 6, 2007

(54) FIREARM ENCLOSURE

(76) Inventor: William S. Pearson, 8 Flintlock Ct., Greenville, SC (US) 29611

( * ) Notice: Subject to any disclaimer, the term of this patent is extended or adjusted under 35 U.S.C. 154(b) by 174 days.

(21) Appl. No.: 10/898,270

(22) Filed: Jul. 23, 2004

Related U.S. Application Data

(63) Continuation-in-part of application No. 10/287,408, filed on Nov. 4, 2002, now abandoned.

(60) Provisional application No. 60/332,833, filed on Nov. 6, 2001.

(51) Int. Cl.
*F41A 35/02* (2006.01)

(52) U.S. Cl. ..... 119/96

(58) Field of Classification Search ..... 42/96, 42/74; 43/26; 206/317; 383/69, 118
See application file for complete search history.

(56) References Cited

U.S. PATENT DOCUMENTS

| | | | | |
|---|---|---|---|---|
| 2,737,136 | A | 3/1956 | Ryder | |
| 3,191,652 | A | 6/1965 | Benson et al. | |
| 3,239,114 | A * | 3/1966 | Norsworthy | 206/317 |
| 3,437,247 | A | 4/1969 | Gantress | |
| 3,701,371 | A * | 10/1972 | Stackhouse | 206/317 |
| 3,720,013 | A | 3/1973 | McDonald | |
| 4,257,464 | A | 3/1981 | Binney | |
| 4,644,987 | A | 2/1987 | Kiang | |
| 4,754,498 | A | 7/1988 | Stinemates | |
| 5,020,194 | A * | 6/1991 | Herrington et al. | 24/400 |
| 5,277,306 | A * | 1/1994 | Sargent | 206/315.11 |
| 5,678,344 | A * | 10/1997 | Jones et al. | 42/96 |
| D413,020 | S * | 8/1999 | Kolpin | D3/262 |
| 6,068,401 | A * | 5/2000 | Ho | 383/97 |
| 6,119,388 | A * | 9/2000 | Jones et al. | 42/96 |
| 6,256,922 | B1 * | 7/2001 | Jones et al. | 42/96 |
| D448,558 | S * | 10/2001 | Kolpin | D3/262 |
| D451,670 | S * | 12/2001 | Knorr et al. | D3/260 |
| 6,626,339 | B2 | 9/2003 | Gates et al. | |
| 6,925,688 | B1 * | 8/2005 | Savicki | 24/30.5 R |
| 2001/0022865 | A1 * | 9/2001 | Meyer et al. | 383/118 |
| 2003/0005614 | A1 * | 1/2003 | Cossio | 42/96 |
| 2005/0118375 | A1 * | 6/2005 | Damiano | 428/36.1 |

* cited by examiner

*Primary Examiner*—Michael J. Carone
*Assistant Examiner*—Susan C. Alimenti
(74) *Attorney, Agent, or Firm*—J. Bennett Mullinax, LLC

(57) ABSTRACT

A firearm enclosure for enclosing a firearm, such as a black powder pistol or rifle, and includes and elongated sleeve portion having an opening at one end into which the firearm is inserted. This opening forms a watertight seal and enclosure, preferably with a resealable closure arrangement. The other end of the sleeve is closed and receives the muzzle of a firearm. This end of the sleeve is enclosed by a material which, while being waterproof, offers little resistance to puncture by a bullet exiting a muzzle, thereby minimizing any deflection or loss of momentum of the bullet. Use of the enclosure protects the firearm during use from the elements such as rain, sleet, snow, fog, and external humidity.

3 Claims, 3 Drawing Sheets

FIREARM ENCLOSURE

This application claims benefit of U.S. Provisional application Ser. No. 60/332,833, filed Nov. 6, 2001, and continuation-in-part of U.S. application Ser. No. 10/287,408, filed Nov. 4, 2002, now abandoned, the entirety of the disclosures of which are incorporated herein by reference thereto.

BACKGROUND OF THE INVENTION

This invention relates to an enclosure for a firearm, and in particular a rifle, and more specifically, to a firearm enclosure for a black powder rifle.

Firearms find use in hunting, target shooting, and military applications. Except for certain indoor uses for firearms, such as in indoor firing ranges, firearms are used outdoors, which makes them subject to ambient weather conditions. While clear and dry weather conditions are most desirable, firearms are also used in inclement weather. This may particularly be the case in military and hunting applications.

Conventional firearms typically have steel components such as steel barrels, receivers, sights, etc., which, if exposed to water or moisture, are susceptible to rust and corrosion. Use of stainless steel for those components can reduce the effects of rain and moisture, but use of stainless steel for such firearm components is the exception.

In order to protect the firearm, particularly if the firearm is a rifle, covers have heretofore been developed. For example, U.S. Pat. Nos. 5,678,344 and 6,256,922, both issued to Jones, et al., disclose firearm casings having openings to allow for the sights of a rifle and the trigger area to be exposed during use. U.S. Pat. No. 4,754,498, issued to Stinemates, discloses a gun mitten for warmth to the shooter's hand during use.

U.S. Pat. No. 4,257,464, issued to Binney, discloses a protective gun cover for use when the gun is not being used.

U.S. Pat. No. 3,701,371 to Stackhouse discloses a flexible plastic rain gun case which may be deployed over a firearm. The Stackhouse gun case provides openings for trigger access and shell ejection and, therefore, does not provide for a moisture-proof case. Similarly, the Stackhouse reference specifically provides air vents to prevent the enclosure from retaining moisture and to facilitate use of the Stackhouse rain gun case for long-term storage. As such, the Stackhouse reference is not moisture proof and does not provide for a waterproof closure which also protects against humidity and other ambient moisture.

With the increased popularity of primitive weapons, black powder rifles have seen renewed interest. Typical firearms today use cartridges for holding gun powder which, upon detonation, propel a bullet carried in the cartridge outwardly through the barrel of a gun. With black powder weapons, and in particular, black powder rifles, a pre-selected amount of black powder is poured into the barrel of the rifle through the open-end of the barrel, also known as the muzzle. Black powder rifles are thus also referred to as "muzzle loaders." This loading method is in contrast to conventional rifles, where the cartridge is inserted into a receiver at the end of the barrel opposite the muzzle end, adjacent to a firing pin.

In loading the black powder rifle, after the black powder has been poured into the muzzle, a bullet, ordinarily together with wadding material, is inserted into the muzzle and pressed downwardly and seated firmly against the powder. The rifle is fired by igniting the black powder, typically using a primer cap or flint lock system activated by pulling of the trigger. The ignition of the black powder causes the bullet and wadding (which serves to reduce premature release of the black powder's explosive gases around the bullet) to be expelled through the barrel out of the muzzle, towards the intended target.

With the cartridge ammunition generally used today, water and moisture effects on the firing of such cartridges, once loaded into a firearm, is generally negligible. This is not the case, however, with black powder firearms. Exposure of black powder to water and moisture directly impacts its performance, and depending on the amount of exposure, could render the black powder useless. Accordingly, once a black powder rifle is loaded, extreme care must be taken to prevent moisture from coming into contact with the black powder therein. Rainy, misty, foggy, or high humidity ambient conditions can significantly impact hunting with black powder firearms, since it is desirable to keep the firearm and powder as dry as possible at all times. It is thus desirable to keep the firearm in a moisture-proof enclosure during such foul weather. However, this obviously poses a problem in actually using the weapon if it is completely enclosed.

Also, a gun cover which is camouflaged would be desirable so as to minimize visibility by the intended prey.

SUMMARY OF THE INVENTION

It is, therefore, an object of the present invention to provide a firearm enclosure for shielding a firearm from rain and moisture.

Another object of the present invention is to provide a firearm enclosure for sealing the muzzle of a rifle during use.

A further object of the present invention is to provide a firearm enclosure which need not be removed to fire and operate the firearm.

Yet another object of the present invention is to provide a firearm cover usable with cartridge-based and black powder firearms.

Still another object of the present invention is to provide a firearm enclosure for providing a substantially waterproof enclosure for a firearm.

Yet another object of the present invention is to provide a firearm cover which includes means for covering a scope of the firearm while still allowing use of the scope.

A further object of the present invention is to provide a firearm cover having a muzzle-covering portion configured for puncture by a bullet fired from the muzzle.

Yet a further object of the present invention is to provide a firearm enclosure which is quiet during use so as to not alert game being hunted.

A further object of the present invention is to provide a firearm cover which is relatively lightweight, inexpensive, and disposable.

It is a further object of at least one embodiment of the present invention to provide for a disposable, lightweight firearm casing which is substantially impervious to moisture, including both liquid and vapor.

Generally, the present invention includes a firearm enclosure for completely enclosing a firearm, such as a pistol or rifle. The enclosure includes an elongated sleeve portion having an opening at one end into which a firearm is inserted. This opening is sealable, preferably with a resealable enclosure. The other end of the sleeve is closed and receives the muzzle of a firearm. This end of the sleeve is enclosed by a material which, while being waterproof, offers little resistance to puncture by a bullet exiting a muzzle, thereby minimizing any defection or loss of momentum of the bullet.

The material used to make the cover is configured to be extremely quiet, thin, and very flexible during use so as to not alert or startle prey being hunted. Several openings are provided in the sleeve, and each preferably includes a resealable enclosure. Such openings may include, optionally, an opening for the front sight of the rifle, the rear sight of the rifle, the action of the rifle or hammer of the muzzle loader, such a lever or bolt action mechanism, and for allowing expulsion of a spent cartridge, etc.

The enclosure could be made of plastic or some other suitable material. The material should be flexible and stretchable to allow the firearm operator to use the rifle while still enclosed in the case. Also, the enclosure could be opaque, transparent, translucent, or bear camouflage markings.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
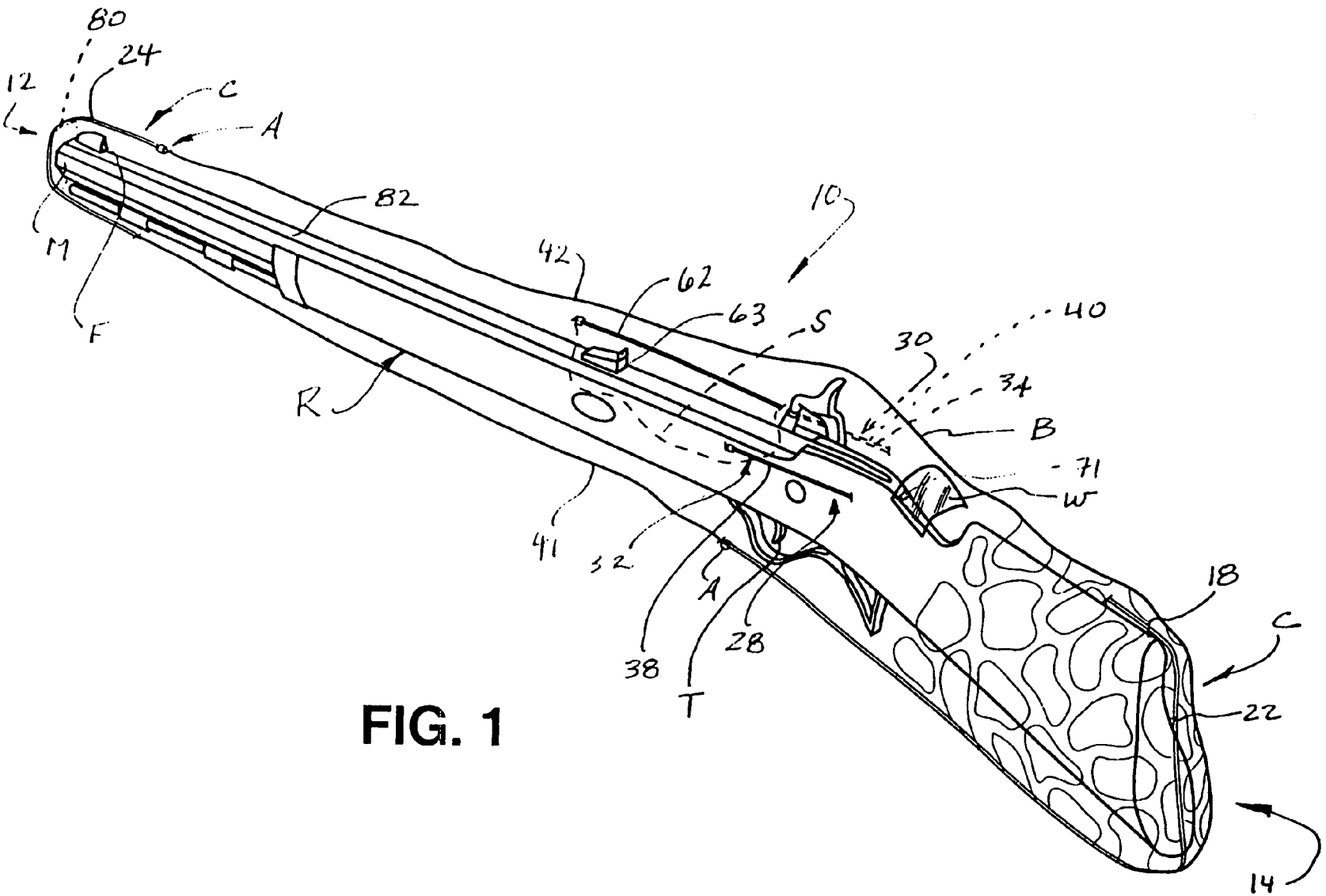
FIG. 1 is a perspective view of a firearm enclosure constructed in accordance with the present invention.

The accompanying drawings and the description which follows set forth this invention in its preferred embodiment. However, it is contemplated that persons generally familiar with firearms and firearm covers will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the firearm enclosure of the present invention is indicated generally in the figures by reference character 10.

Turning to FIG. 1 of the drawings, firearm enclosure 10 is shown having a rifle, generally R, enclosed therein. Firearm enclosure 10, is, in general terms, an elongated bag-like enclosure, which in a preferred embodiment is a sleeve, generally B, having a plurality of openings therein. Each of the openings includes a resealable closure, generally C, which could be a plastic zipper, a "zip lock" water- and moisture-proof closure or some other moisture- and liquid-proof closure means. In a preferred embodiment, plastic zippers, of the type having interlocking ridges similar to that of a ziplock closure are used, and a sealing actuator, generally A, is provided for each resealable closure C. The plastic zipper provides for a moisture- and liquid-tight seal. Although the firearm enclosure 10 is illustrated in use with a long gun, such as a rifle, it is to be understood that it can be modified to accommodate pistols, and in particular black powder pistols.

In a preferred embodiment, the firearm enclosure 10 is preferably constructed to provide a substantially moisture-proof enclosure. As such, the firearm enclosure 10 provides for moisture-proof seal(s) and provides not only a barrier to liquids such as rainfall, mist, and dew, but also protects against water vapor such as high humidity conditions. High humidity conditions can adversely affect the performance of a black powder firearm as the powder absorbs moisture from the air. Firearm enclosure 10, providing a moisture-proof covering, prevents the powder within the firearm from absorbing moisture from the open muzzle or primer tube.

Conversely, because of the moisture-proof properties of the firearm enclosure 10, the firearm enclosure 10 is not designed for long term storage of a firearm. The moisture-proof properties of the firearm enclosure 10 would trap moisture within the interior of the enclosure, creating potentially damaging conditions for the gun giving rise to mold, rust, or other undesirable conditions.

Sleeve B includes an end or forward portion, generally 12, and an end or rearward portion generally 14. The rearward portion 14 accommodates the butt, generally 18 of rifle R, as shown in FIG. 1. An opening 20 (FIG. 3) is provided in rearward portion 14 through which rifle R is inserted, upon resealable closure 22 in end 14 being open. At forward end 12 of sleeve B, an optional resealable closure C may be provided as indicated specifically by reference numeral 24.

Sleeve B includes side portions 28 and 30 and optional openings 32 and 34 may be provided in side portions 28, 30, respectively. Opening 32 includes resealable moisture- and liquid-proof closure 38, and opening 34 includes a resealable moisture- and liquid-proof closure 40. Also included on sleeve B is a lower portion, generally 41, and an upper portion, generally 42. It is to be noted that optional resealable closure 24 extends along lower portion 41, end 12, and upper portion 42 of sleeve B. Likewise, resealable closure 22 extends along lower portion 41, rear portion 14, and upper portion 42 of sleeve B.

Optionally, a transparent window, generally W, may be provided in sleeve B and extends along side portion 28, upper portion 42, and side portion 30 of sleeve B. Window W allows the user to see whether the safety 71, which could be a switch, button, lever, etc., of the rifle R, is on or off. The entire sleeve B can be clear, if necessary, to allow the safety to be viewed.

Figure 2:
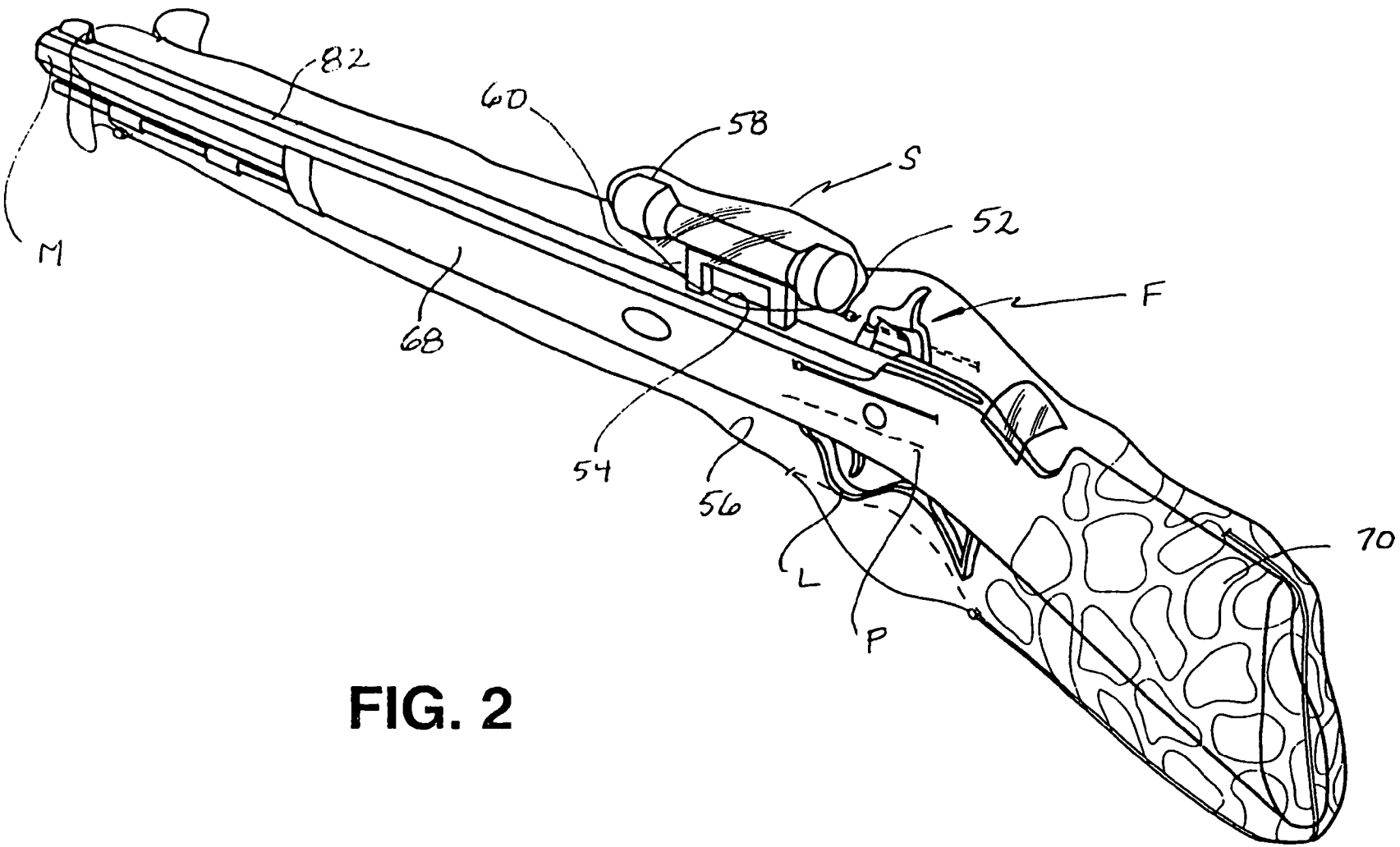
FIG. 2 is a perspective view of a firearm enclosure constructed in accordance with the present invention having a scope enclosure.

As shown in FIG. 2, and in phantom in FIG. 1, an optional scope cover, generally S, may be provided in sleeve B enclosing and covering scope 58. Scope cover S extends upwardly through opening 52 in the upper portion 42 of sleeve B and is preferably a gusseted portion and which may have an opening 54 in communication with the interior or compartment, or interior compartment 56 of sleeve B. Scope cover S is preferably made of transparent material, which could be the same material as window W, such transparent material preferably being clear, flexible plastic.

A neck portion 60 of scope cover S is sealed to upper portion 42 of sleeve B in watertight fashion. To use, scope cover S is withdrawn through opening 52 through resealable closure 62 (once resealable closure 62 has been operated to open opening 52). If the rifle R being used has no scope, then scope cover S remains within the interior compartment 56 of sleeve B, and resealable closure 62 remains sealed. In this event, scope cover S would simply be positioned to the left or right side of the stock 68 of rifle R.

A camouflage pattern, generally 70, can be applied to the exterior of sleeve B if desired in order to diminish the visibility of firearm enclosure 10 during use.

Sleeve B is preferably constructed of a waterproof material, such as plastic, and in a preferred embodiment is constructed of polyethylene of a nature which will be soft and supple and have adequate flexibility to allow a firearm to be manipulated through the material. Preferably the material is such that it is not prone to emitting crackling or crinkling noises when manipulated by the user, as these noises could startle prey being hunted. Such material could be transparent, translucent, one color, such as green, brown, or black, or could be camouflaged, as referenced above.

Figure 3:
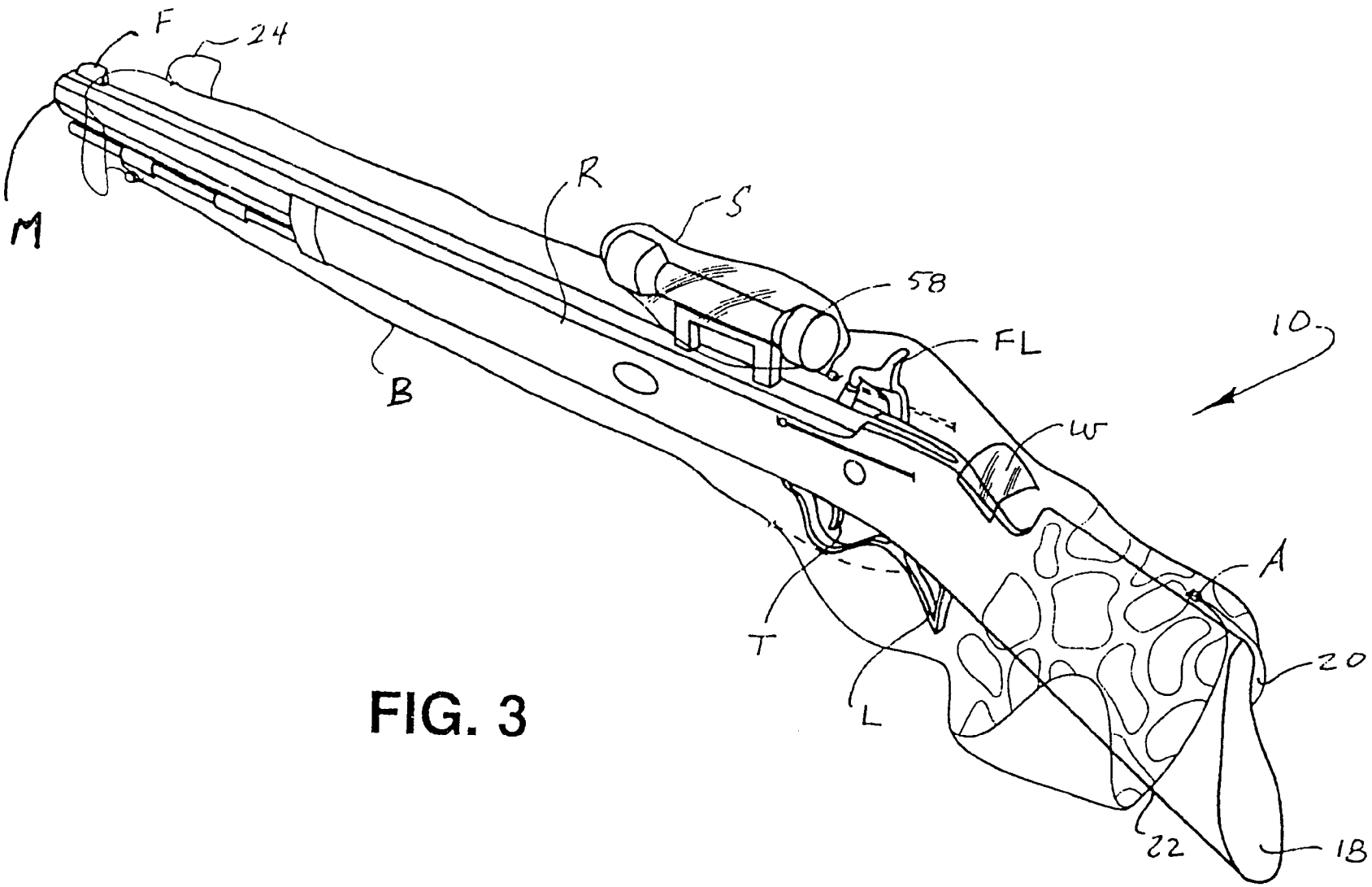
FIG. 3 is a perspective view of a firearm enclosure constructed in accordance with the present invention having several openings thereof being shown in an open configuration.

FIG. 3 illustrates sleeve B, receiving rifle R. Note that closure 22 at rearward end 14 of sleeve B is open for allowing insertion of rifle R into the interior compartment 56 of sleeve B. Scope cover S has been extracted through opening 52, and scope 58 of rifle R has been inserted therein. Resealable closure 24 at the forward end 12 of sleeve B is shown in open configuration.

Closure 24 can be closed entirely, or, if a zipper type actuator A is used, the actuator could be moved from the position on upper portion 42 of sleeve B shown in FIG. 1 slightly forward towards muzzle, generally M, of rifle R a sufficient distance to expose front sight, generally F, of rifle R. In this instance, the opening of muzzle M would remain covered by end 12 of sleeve B, thereby substantially sealing the opening of the muzzle M from moisture.

In order to ensure end 12 is tight against muzzle M, ordinary tape, such as, for example, duct tape or electrical tape, or elastic members, such as elastic bands, straps, etc., can be used around the exterior of sleeve B in order to make sleeve B generally tight about rifle R. Such tape could be used at various places along sleeve B to obtain the desired snugness of sleeve B about rifle R, and also the desired looseness, or flexibility of sleeve B about rifle R. It is particularly advantageous to keep a snug fit of Sleeve B about the barrel of rifle R. In this manner, explosive gases released from the muzzle will exit through the end of the bag as opposed to inflating the bag full of hot gases.

For example, if firearm enclosure 10 is used on a rifle R having a lever action, using for example, lever L, then the area of sleeve B surrounding lever L would be kept relatively loose, to allow the user to operate the lever L through the walls of sleeve B. Similarly, if the firearm included a flintlock mechanism, generally FL, the area of sleeve B around flintlock mechanism FL would likewise be kept slack in order to allow the mechanism FL to be manipulated through sleeve B, while rifle R is therein.

Optional opening 32 on side 28 of sleeve B and optional opening 34, on side 30 of sleeve B may be used if rifle R is of the type that ejects spent bullet casings, and in such event, generally either opening 32 or opening 34 would be opened when a casing is to be expelled. Closure 22 could also be opening partially, by moving actuator A thereof towards rear portion 14 of sleeve B in order to allow the lever L of the lever action to be actuated. The optional areas to be opened can be outlined with pre-formed score lines to facilitate the tearing of an appropriate opening when needed. Until the opening is accessed by the user, the enclosure with score lines maintains the moisture-proof barrier properties.

In use, sleeve B would be used when it is anticipated that hunting or other shooting would occur during foul weather. It is to be understood that firearm enclosure 10 should not be used for long term storage of a gun which would create moisture damage problems. In order to insert the rifle into the interior compartment 56 of sleeve B, opening 20 is opened by opening resealable closure 22, and the rifle is then inserted into compartment 56. The sleeve B can be used as is, or taped in order to provide enough slack to work the trigger T of rifle R.

If the rifle has a scope, resealable closure 62 would be opened, and scope cover S extracted through opening 52 such that it covered scope 58 of the rifle. It is to be understood that closures other than the resealable closures discussed here could be used. For example, in order to reduce costs, the openings in sleeve B could be pre-scored with lines P such that the openings remained watertight until punctured along the perforations. In this situation, however, once the score lines P are pierced, the opening may not be resealable and should be discarded and replaced.

Firearm enclosure 10 could be manufactured with or without a scope cover S, and in the event a scope 58 is not used, then the actuator A of opening 52 would be moved, rearwardly, as shown in the present embodiment, to the extent necessary to expose rear sight 63, Adhesive tape could be used to close any opening which may need to be sealed in order to provide a temporary seal around rear sight 63. Similarly, actuator A of closure 24 would be moved forward, as discussed above, in order to expose front sight F.

Preferably the portion of sleeve B directly in front of the muzzle opening is thin and has the property of being easily punctured. This section 80 of sleeve B may, thus, be of the same or different material than the remainder of sleeve B, and, if of a different material than the other portions of Sleeve B, may be held into place by adhesive, tape, or other means and could be replaceable. The purpose of such section 80 is to provide a watertight closure over the end of muzzle M, in order to prevent water from running down the barrel 82, which is extremely undesirable when using a black powder rifle (as discussed above). Section 80 is preferably polyethylene, but is drawn in a manner which allows for it to be easily punctured, thereby offering minimal resistance to a bullet expelled from muzzle M, and thus having negligible effect over the momentum of the bullet and on the aiming thereof.

Preferably, closure 24 is positioned to pass to the left or right of the end of muzzle M in order to present section 80 to the end of the muzzle, to thereby minimize impact on the bullet as it passes through sleeve B.

Once a firearm, such as rifle R, has been inserted into sleeve B, and the resealable closures closed as discussed above, the firearm is ready for use in inclement weather. In the case of a black powder rifle, once a shot is fired, sleeve B should be disposed of.

From the foregoing, it can be seen that the present firearm enclosure 10 provides a temporary firearm covering which allows the user to hunt, field transport, and operate a rifle under foul weather conditions, while the gun and black powder remains dry. The firearm enclosure 10 allows the finish, wood, and other working parts of handguns, primitive rifles, rifles, and other firearms to be protected from rain, sleet, snow, mist, fog, high humidity, and mud resulting from foul weather conditions, and need not be removed in order to fire and operate the firearm. Further, Firearm enclosure 10 should be disposed of after use. Firearm enclosure 10 is particularly effective on black powder guns, serving to keep water off of the gun and humidity and moisture away from the powder therein.

A variety of different plastic materials in various gauges of thickness may be used. For instance, when a low density polyethylene film is used to make the enclosure sleeve, a thickness of approximately 0.5 to 2.0 mils has been found to work well. Where a polyethylene film is used, it is helpful to use a low density non-oriented polyethylene film having high elongation. This allows the sleeve material to be stretched. A non-oriented film having high elongation properties minimizes the risk that a gun sight, muzzle, or other edge of a firearm will tear the plastic when being inserted into the enclosure. A high elongation plastic material also allows the enclosure to be pulled tight, i.e., slightly stretched, over the barrel and gun sights. In this manner, when the extra material is taped or otherwise held in place, it is possible for the hunter to view the mechanical sight on the firearm even with the plastic in place. This "stretch to fit" capability of the high elongation plastic is desirable in that even when elongated the plastic sleeve maintains the water and moisture barrier properties.

Other plastic materials which can be used include not only low density polyethylene but other forms of polyethylene, polypropylene, other olefins, polyester, and latex. As stated above, it is preferable that these materials also have high elongation, non-oriented properties. In addition to the stretch and elongation properties, such films are believed to be quieter and make less noise when being moved or carried.

An additional advantage of the film enclosure having high elongation and stretch properties is that the portion of the sleeve around the trigger can be manually stretched and expanded while maintaining the moisture and liquid barrier properties. In this manner, plenty of clearance can be provided for the user of the firearm to engage the trigger without the requirement of an opening through which the trigger would be operated.

In a preferred embodiment using a high elongation and stretchable plastic material, it may be advantageous to add through score lines induced weaknesses in the plastic which can thereafter be more easily punctured by the user. In this manner, pre-established openings can be provided which maintain their integrity against moisture until and unless the openings are created by the user.

The present enclosure is not designed to protect the weight of the gun and is not suitable for having a handle attached in order to carry a firearm. Additionally, it is noted that the present enclosure is not designed to protect the gun from scratches from transportation, barbed wire fences, or damage if the enclosed firearm is accidentally dropped. Likewise, the present enclosure is not a protective storage gun case nor is it intended for long-term storage of a firearm.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the invention herein disclosed.

What is claimed is:

1. A method of using a black powder firearm comprising:

providing a black powder firearm containing therein a supply of black powder;

placing said black powder firearm within a plastic sleeve, said plastic sleeve conforming generally to the dimensions of a firearm and having at least one opening defined by the plastic sleeve wherein said at least one opening may be reversibly sealed thereby providing a moisture proof enclosure surrounding said black powder firearm;

stretching said plastic sleeve against a barrel and a mechanical gunsight positioned on said barrel, thereby allowing the operative use of said mechanical gunsight when said black powder firearm is within said sleeve, while maintaining said fire arm and said black powder in a moisture proof enclosure;

additionally stretching said plastic sleeve in proximity to a trigger of said fire arm;

wherein, when said firearm is discharged, said muzzle blast creates an opening within said sleeve opposite said gun muzzle allowing said bullet to exit said enclosure.

2. A method of using a black powder firearm comprising:

providing a black powder firearm containing therein a supply of black powder;

placing said black powder firearm within a plastic sleeve, said plastic sleeve conforming generally to the dimensions of a firearm and having at least one opening defined by the plastic sleeve wherein said at least one opening may be reversibly sealed thereby providing a moisture proof enclosure surrounding said black powder firearm;

stretching a portion of said plastic sleeve adjacent a barrel against said barrel and a mechanical gunsight positioned on said barrel, said portion of said plastic sleeve thereby conforming to a shape of said barrel and said mechanical gunsight and thereby allowing the operative use of said mechanical gunsight when said black powder firearm is within said sleeve, while maintaining said fire arm and said black powder in a moisture proof enclosure;

stretching a portion of said plastic sleeve in proximity to a trigger of said fire arm;

wherein, when said firearm is discharged, said muzzle blast creates an opening within said sleeve opposite said gun muzzle allowing said bullet to exit said enclosure and said stretch plastic stretched about said barrel and said mechanical gunsight prevents the muzzle blast from directing combustion gases within an interior of said plastic sleeve.

3. The method according to claim 2 wherein following said step of stretching a portion of said plastic sleeve adjacent a barrel, said plastic sleeve is maintained in a stretched configuration adjacent said barrel.

* * * * *